US006145224A

United States Patent [19]

Stickling

[11] Patent Number: 6,145,224

[45] Date of Patent: Nov. 14, 2000

[54] GROUND ENGAGING TOOLS FOR EARTHWORKING IMPLEMENTS AND RETAINER THEREFOR

[75] Inventor: Christopher J. Stickling, Dunlap, Ill.

[73] Assignee: Caterpillar Inc., Peoria, Ill.

[21] Appl. No.: 09/187,678

[22] Filed: Nov. 6, 1998

[51] Int. Cl.[7] ..... E02F 9/28

[52] U.S. Cl. ..... 37/458; 37/456

[58] Field of Search ..... 37/458, 457, 456, 37/455

[56] References Cited

U.S. PATENT DOCUMENTS

| | | | |
|---|---|---|---|
| 42,764 | 5/1864 | Harrington | 16/229 |
| 2,325,991 | 8/1943 | White | 37/458 |
| 2,610,417 | 9/1952 | Crawford . | |
| 2,861,362 | 11/1958 | Liard et al. . | |
| 3,025,619 | 3/1962 | Towne et al. | 37/458 |
| 3,312,003 | 4/1967 | Troeppl et al. | 37/457 |
| 3,323,235 | 6/1967 | Petersen | 37/457 |
| 3,325,926 | 6/1967 | Wilson . | |
| 3,932,952 | 1/1976 | Helton et al. | 37/141 R |
| 4,192,089 | 3/1980 | Schwappach | 37/457 |
| 4,848,013 | 7/1989 | Bowman et al. | 37/457 |
| 5,068,986 | 12/1991 | Jones | 37/142 A |
| 5,088,214 | 2/1992 | Jones . | |
| 5,272,824 | 12/1993 | Cornelius | 37/458 |
| 5,423,138 | 6/1995 | Livesay et al. | 37/456 |
| 5,724,756 | 3/1998 | Gale | 37/458 |
| 5,765,301 | 6/1998 | Clendenning | 37/457 |
| 5,881,150 | 3/1999 | Persson | 379/433 |
| 5,937,551 | 8/1999 | Moehnke et al. | 37/459 |

FOREIGN PATENT DOCUMENTS

| | | |
|---|---|---|
| 1652484 | 1/1972 | Germany . |
| WO 98/44208 | 10/1998 | WIPO . |
| WO 99/23315 | 5/1999 | WIPO . |

OTHER PUBLICATIONS

U.S. application Serial No. 08/825,822, filed Mar. 31, 1997.

*Primary Examiner*—Thomas B. Will
*Assistant Examiner*—Meredith C. Petravick
*Attorney, Agent, or Firm*—O. Gordon Pence

[57] ABSTRACT

An earthworking implement adapted to normally engage the ground in a primary direction of travel has a replaceable ground engaging tool retained onto a tool mounting portion of the implement by an elongated retainer. The tool mounting portion has an exterior surface with a first retainer pocket providing a first abutment surface facing in a direction substantially away from the primary direction of travel. The ground engaging tool, in turn, has an interior surface with a second retainer pocket positionable in alignment with the first retainer pocket and provides a second abutment surface disposed in a generally spaced, diametrically opposing relationship to the first abutment surface. An elongated retainer is positionable within the retainer pockets and has a pair of opposite solid end portions oriented to abut the first and second abutment surfaces such that the end portions restrict the tool from coming off the mounting portion in the direction of the primary direction of travel.

20 Claims, 5 Drawing Sheets

GROUND ENGAGING TOOLS FOR EARTHWORKING IMPLEMENTS AND RETAINER THEREFOR

TECHNICAL FIELD

The present invention relates generally to ground engaging tools for earthworking implements and the like and, more particularly, to a compression retainer for detachably retaining a replaceable tool onto such implements.

BACKGROUND ART

Earthworking implements, such as buckets for loaders and excavators, bulldozers blades or rippers for tractors, bowls for scrapers and other earthworking machines commonly employ ground engaging tools that engage the earth being worked or materials being excavated or loaded. Because of the highly abrasive materials encountered, ground engaging tools wear out rapidly and need to be replaced in order to protect the parent material of the implement and to keep the implement working at peak efficiency. Because of such frequent replacement, it is desirable to be able to quickly and easily remove the worn tool and replace it with a new one. Many types of retention devices, such as pins and the like, have been used in the past to retain the tool onto the implement or a tool mounting portion provided on the implement. Some typical examples of retention devices used for retaining bucket teeth are disclosed in U.S. Pat. No. 5,068,986 issued Dec. 3, 1991 to Larren F. Jones for Excavating Tooth Point Particularly Suited for Large Dragline Buckets; U.S. Pat. No. 5,272,824 issued Dec. 28, 1993 to Erwin D. Cornelius for Tooth Assembly with Leaf Spring Retainer; and U.S. Pat. No. 5,423,138 issued Jun. 13, 1995 to Richard E. Livesay, et al for Tip to Adapter Interface.

Many such prior retention devices perform satisfactorily, but are either complex and expensive, or require special tools or the large exertion of effort to remove and replace the retainers. Other retainers may simply fail during use due to the high loads exerted on such retainers during use, resulting in the loss of the tool from the implement.

The present invention is directed to overcoming one or more of the problems encountered in the use of prior art tools and retention devices.

DISCLOSURE OF THE INVENTION

In accordance with one aspect of the present invention, an earthworking implement adapted to normally engage the ground in a primary direction of travel includes a tool mounting portion having an exterior surface with a first retainer pocket therein. The first pocket provides a first abutment surface facing in a direction substantially away from the primary direction of travel. A replaceable ground engaging tool has an interior surface positionable along the exterior surface of the mounting portion. The interior surface has a second retainer pocket therein positionable in alignment with the first retainer pocket of the mounting portion. The second pocket provides a second abutment surface disposed in a generally spaced, diametrically opposing relationship to the first abutment surface of the first retainer pocket. An elongated retainer having a pair of opposite solid end portions is positionable within the first and second retainer pockets wherein each end portion of the retainer is oriented to abut the first and second abutment surfaces of the mounting portion and the tool, respectively, such that the end portions of the retainer restrict the tool from coming off the mounting portion in the direction of the primary direction of travel of the implement.

In another aspect of the present invention, the retainer includes an elongated, generally cylindrical steel body disposed along a longitudinal axis. The body has a pair of solid opposite end portions and a compressible middle portion. Each of the end portions has a circular cross-section with centers coincident to the longitudinal axis that are capable of carrying, in compression, a high load oriented radially to the end portions. The compressible middle portion is disposed between the opposite end portions and includes a spring whereby the retainer is provided with a predetermined free length along its longitudinal axis when the spring is in a noncompressed state and a shorter compressed length when the spring is in a compressed state.

In yet another aspect of the present invention, the ground engaging tool includes an elongated body tapering from a wide mounting end portion to a narrow ground engaging end portion. The mounting end portion has an open cavity facing generally away from the primary direction of travel. The cavity is defined by legs including a first leg. The first leg has an interior surface and an exterior surface. The interior surface has an elongated pocket formed therein having providing an abutment facing in a direction of the primary direction of travel. The exterior surface has an opening adapted to allow the passage of the retainer therethrough into the pocket.

BEST MODE FOR CARRYING OUT THE INVENTION

Figure 1:
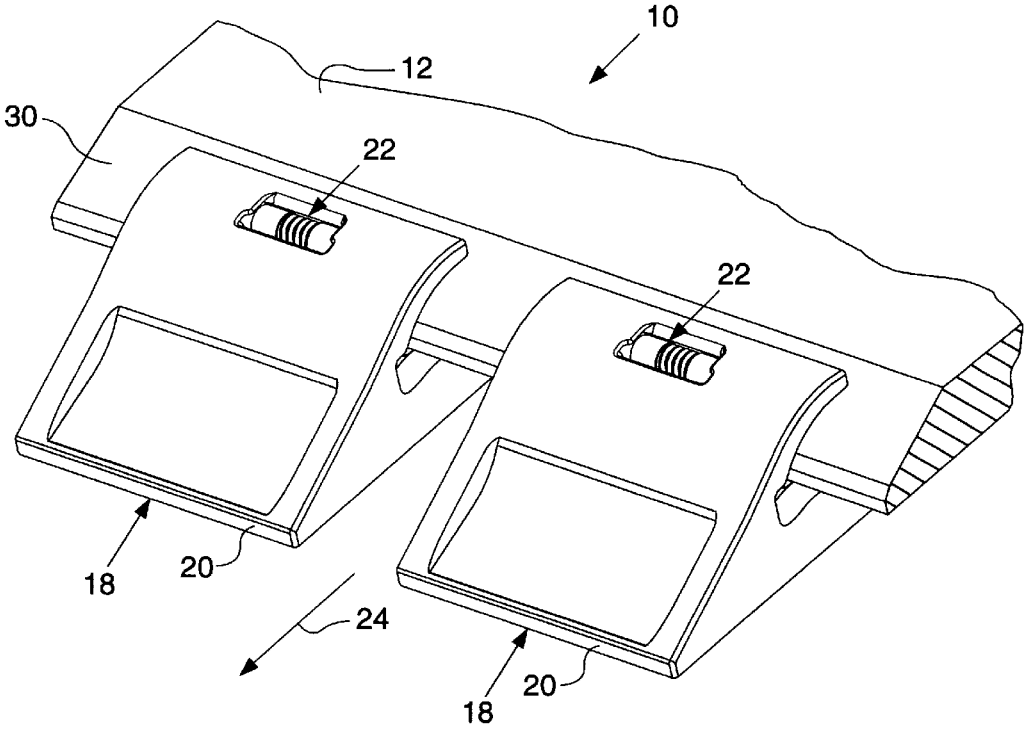
FIG. 1 is a fragmentary perspective view of an implement with a tool mounted onto a mounting portion thereof and being retained by a compression retainer embodying the principles of the present invention.
Figure 2:
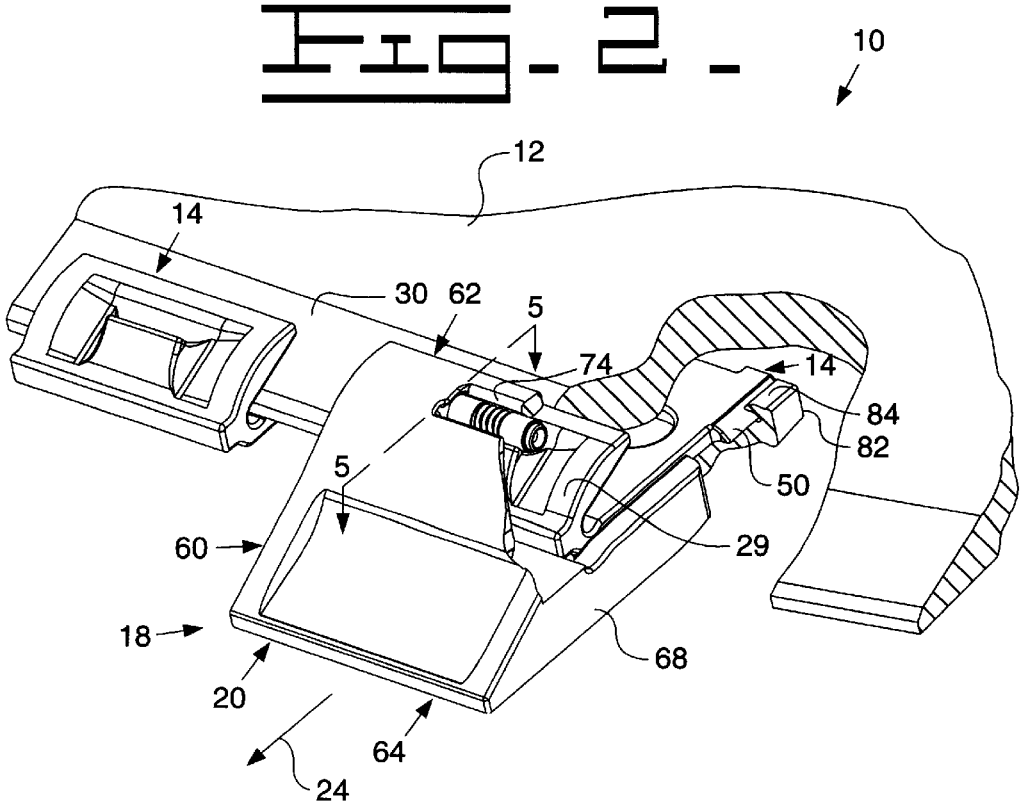
FIG. 2 is an enlarged perspective view of the tool shown in FIG. 1 with portions broken away to better show the mounting portion and the retainer.
Figure 4:
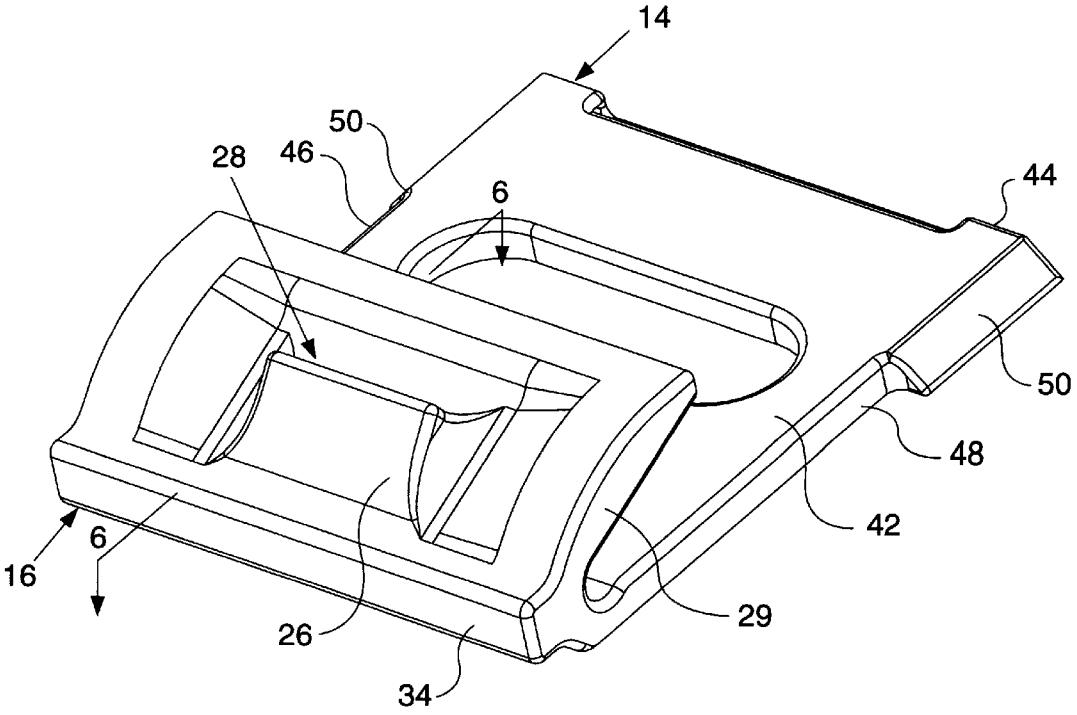
FIG. 4 is a perspective view of the mounting lug for mounting the tool shown by itself.

Referring to the drawings, one exemplary embodiment of the present invention is disclosed in FIG. 1 where an earthworking implement is shown at 10, which in the embodiment depicted is a bucket. The bucket 10 has a cutting edge 12 upon which is mounted, preferably by welding, a plurality of mounting lugs 14; best shown in FIGS. 2 and 4. Each mounting lug 14 has a tool mounting portion 16 for mounting a replaceable ground engaging tool 18, which in the embodiment depicted in FIG. 1 is a cutting edge protecting shroud 20. The shroud 20 is detachably retained on the mounting portion 16 by an elongated retainer 22, as will be more fully described below.

It should be appreciated that the exemplary embodiments depicted in the drawings and described herein are merely for illustrative purposes, as it is contemplated that the present invention be used for other closely related ground engaging tools and implement applications. Examples of related implements include shovels, bulldozer and motor grader blades, rippers, scraper bowls and the like. Examples of tools for such implements include bucket tips, cutting edges, corner and side protectors, tooth couplers and adapters and the like. Such implements, mounting members and tools therefor are all well known in the art and all of such uses are intended to be covered by the present invention even though they have not been specifically shown or described herein, as those skilled in the art are readily able to incorporate the teachings of the present invention into such other applications.

Earthworking implements, such as bucket 10, are adapted to normally engage the ground in a primary direction of travel. In other words, they are manipulated to dig or scoop material in a particular direction by the earthworking machine and/or the operator of such machine. In the case of bucket 10, for instance, the primary direction of travel is typically parallel to and in a direction away from the cutting edge 12 of the bucket, as designated by arrow 24 in FIG. 1.

Figure 6:
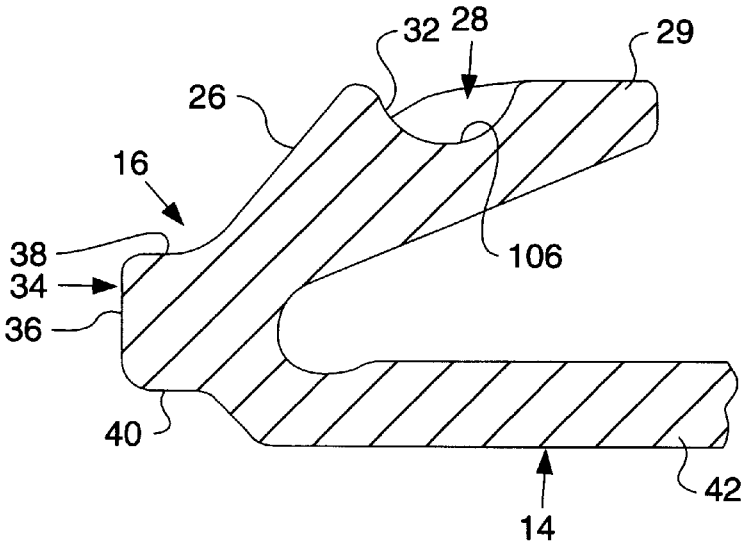
FIG. 6 is an enlarged fragmentary cross-sectional view of the mounting lug by itself taken generally along line 6—6 of FIG. 4.

Mounting lugs 14 are carried in a spaced side-by-side relationship on the cutting edge 12. The tool mounting portion 16 (FIG. 4) of each mounting lug 14 has an exterior surface 26 with a first retainer pocket 28 therein. The exterior surface 26 with the first retainer pocket 28 is preferably located on an upper leg 29 of the mounting lug 14. Such upper leg 29 is adapted to angle upwardly over and embrace the beveled front edge 30 of the cutting edge 12. The first pocket 28 provides a first abutment surface 32 (FIG. 6) facing in a direction substantially away from said primary direction of travel 24.

Each mounting lug 14 includes a nose portion 34 having a first planar force receiving end surface 36 thereon oriented normal to the direction of travel and a pair of spaced second and third force receiving surfaces 38,40, each normal to and adjoining the first force receiving surface and parallel to the direction of travel. The mounting lug 14 also has an elongated lower leg 42 having a distal end 44 opposite the nose portion 34. The lower leg 42 has opposite sides 46,48, each of such sides being provided with an outwardly beveled flange 50 thereon adjacent the distal end 44.

Figure 5:
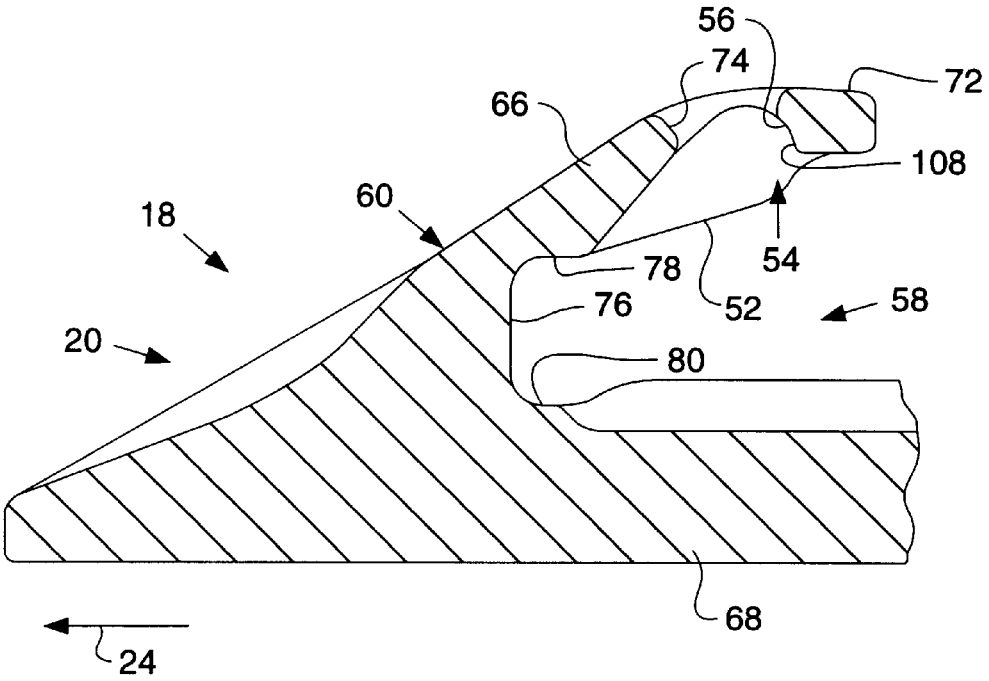
FIG. 5 is an enlarged fragmentary cross-sectional view of the tool by itself taken generally along line 5—5 of FIG. 2.

The replaceable ground engaging tool 18 has an interior surface 52 (FIG. 5) positionable along the exterior surface 26 of the mounting portion 16 of lugs 14. Such interior surface 52 has a second retainer pocket 54 therein positionable in alignment with the first retainer pocket 28 of the mounting portion 16. The second pocket 54 provides a second abutment surface 56 disposed in a generally spaced, diametrically opposing relationship to the first abutment surface 32 of the first retainer pocket 28.

The ground engaging tool 18 also has a cavity 58 opening in a direction opposite to the primary direction of travel 24, the cavity 58 being adapted to receive the tool mounting portion 16 for mounting the tool 18 onto the mounting portion 16.

In the present embodiment, as noted earlier, the ground engaging tool 18 is a lip protecting shroud 20 (FIG. 2) adapted to be mounted on the mounting lug 20 for protecting a bucket cutting edge 12. Shroud 20 has an elongated body 60 tapering down from a wide mounting end portion 62 to a narrower ground engaging end portion 64. The mounting end portion 62 has a first leg 66 and a second leg 68 spaced from the first leg 66 so as to define the open cavity 58 therebetween. The first leg 66 has the aforementioned interior surface 52 and also has an opposite exterior surface 72 (FIG. 5), the exterior surface 72 having a retainer opening 74 therein through to the second retainer pocket 54. The cavity 58 further has a first force transferring surface 76 at the juncture of the legs 66,68 and a pair of opposing second and third force transferring surfaces 78,80. The first force transferring surface 76 is preferably oriented normal to the direction of travel. The pair of opposing force transferring surfaces 78,80 are each normal to and adjoin the first force transferring surface 76 and are parallel to the primary direction of travel. The first force transferring surface 76 is positionable in force transferring abutment with the first force receiving surface 36 on the nose portion 34 of the mounting lug 14, while each of the opposing force transferring surfaces 78,80 is positionable in force transferring abutment with a respective one of spaced second and third force receiving surfaces 38,40 on the nose portion 34 of the mounting lug.

Figure 7:
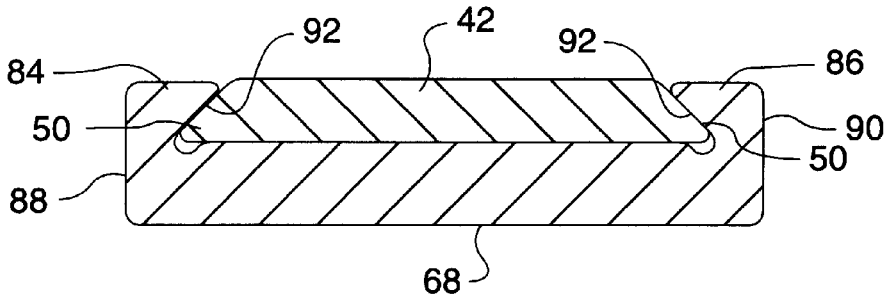
FIG. 7 is a cross-sectional view through the rear of the mounting lug and tool taken generally along line 7—7 of FIG. 3.

The second leg 68 of the shroud 20 has a distal end 82 and a pair of inner flanges 84,86 (FIG. 7) along a respective one of its opposite sides 88,90. Each of the flanges 84,86 have an inwardly beveled portion 92 thereon adjacent the distal end 82 that are adapted to receive a respective one of the outwardly beveled flanges 50 of the lower leg 42 of the mounting lug 14.

As mentioned earlier, the compression retainer 22 (FIG. 8) is for use in detachably retaining replaceable ground engaging tool 18 onto the earthworking implement 10. Retainer 22 includes an elongated, generally cylindrical steel body 94 disposed along a longitudinal axis 96 and has a pair of solid opposite end portions 98,100 and a compressible middle portion 102. Each of the end portions 98,100 have a circular cross-section with centers coincident to the longitudinal axis 96 and are capable of carrying, in compression, a high load oriented radially to the end portions 98,100. The compressible middle portion 102 is disposed between the opposite end portions 98,100 and is axially compressible along longitudinal axis 96, whereby the retainer 22 is provided with a predetermined free length along its longitudinal axis 96 when the spring 104 is in a noncompressed state and a shorter compressed length when the spring 104 is in a compressed state.

The retainer 22 is positionable within the first and second retainer pockets 28,54 (FIGS. 5 and 6) wherein the end portions 98,100 are oriented to abut the first and second abutment surfaces 32,56 of the mounting portion 16 and the tool 18, respectively, such that the end portions 98,100 of the retainer 22 restrict the tool 18 from coming off the mounting portion 16 in the direction of the primary direction of travel of the implement.

It should be noted at this point that the retainer opening 74 in the shroud 20 is provided with a predetermined length that is less than the free length but greater than the compressed length of the retainer 22 in order to permit the insertion of the retainer 22 through the opening 74 when in the compressed state but to prevent the escape of the retainer therethrough when in the noncompressed state.

Figure 3:
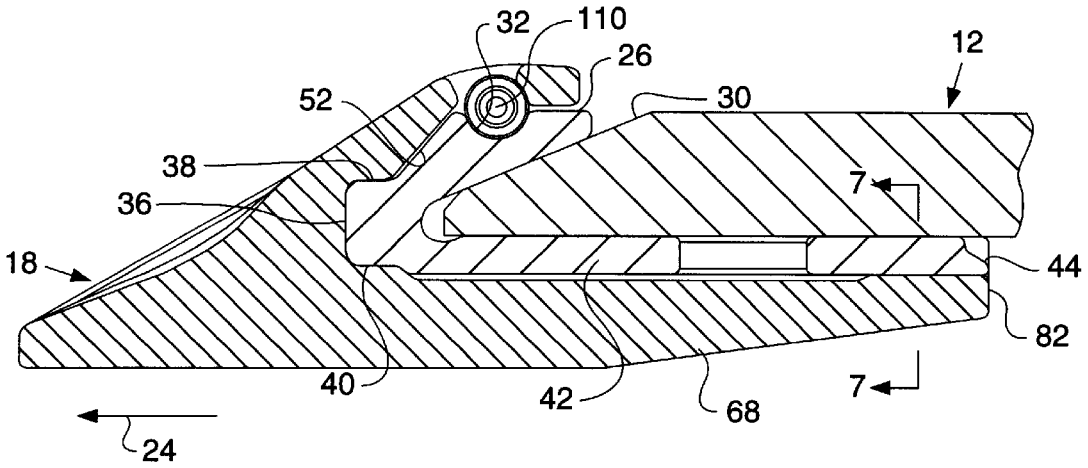
FIG. 3 is a cross-sectional view taken generally along line 3—3 of FIG. 2.

It should also be noted that the first abutment surface 32 of the tool mounting portion 16 and the second abutment surface 56 of the ground engaging tool 18 each preferably have cylindrical portions 106,108, respectively, thereon. Each such cylindrical portion 106,108 is also preferably disposed about a central axis 110 (FIG. 3) oriented generally transverse to the primary direction of travel 24 and arranged such that the cylindrical portions 106,108 of the first and second abutment surfaces 32, 56 contact the end portions 98,100 of the retainer 22 in diametrically opposed relationship to each other, whereby the retainer 22 is caused to be loaded in compression, rather than in shear.

Figure 8:
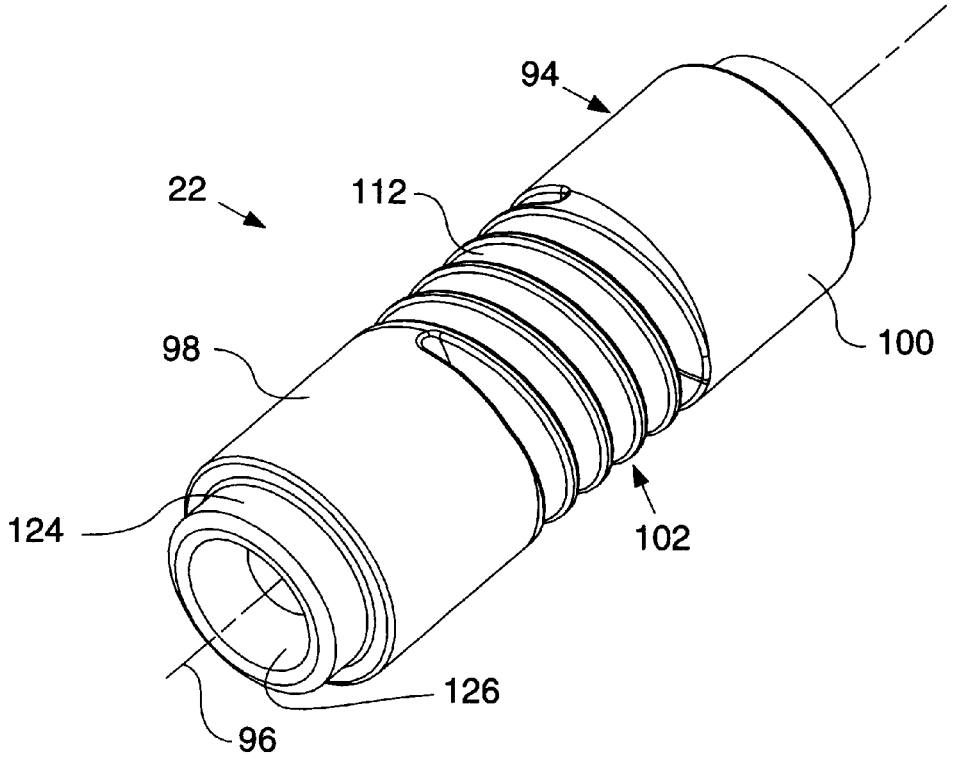
FIG. 8 is an enlarged perspective view of one embodiment of the retainer by itself.
Figure 9:
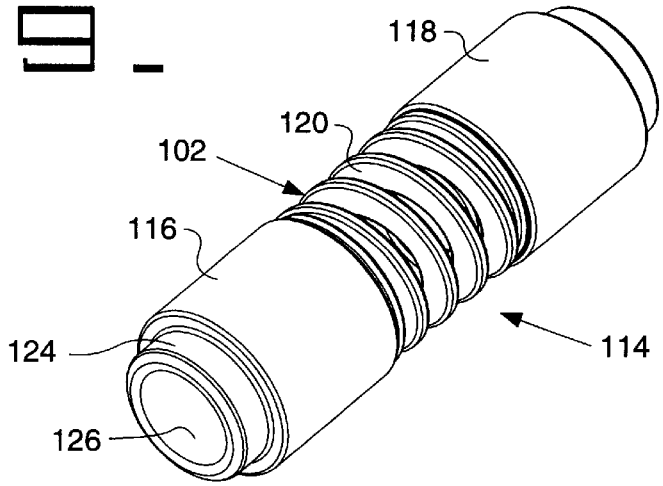
FIG. 9 is an enlarged perspective view similar to FIG. 8, but of another embodiment of the retainer.
Figure 10:
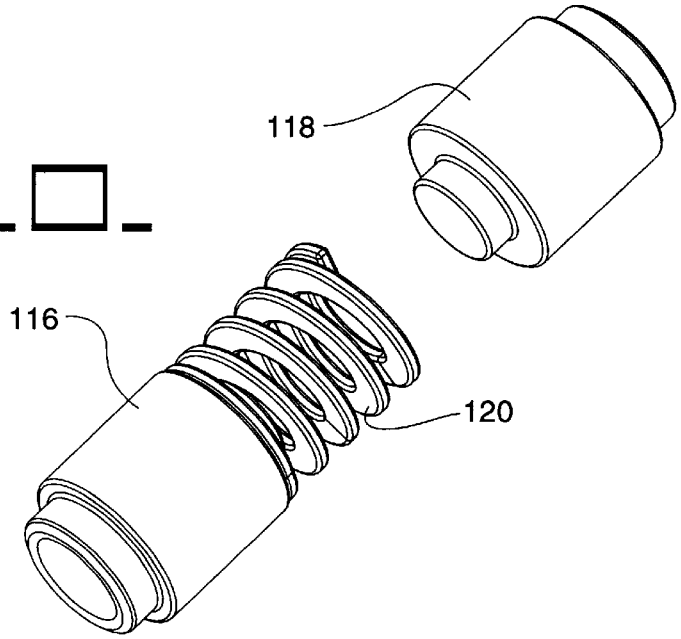
FIG. 10 is an exploded perspective with of the retainer of FIG. 9.
Figure 11:
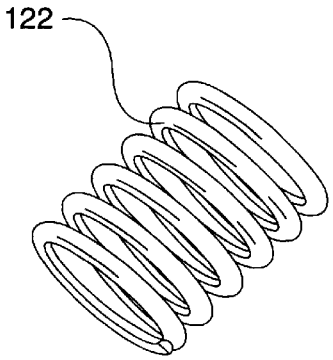
FIG. 11 is a perspective view of an alternate spring for the retainer of FIG. 9.

The axially compressible middle portion of the retainer is preferably a helical spring 112. The helical spring 112 is also preferably constructed integral with the opposite end portions 98,100. This may be accomplished by casting the retainer 22 through a suitable steel metal casting process, with the helical spring 112 being cast in a double helix configuration as shown in FIG. 8. In such a case, the entire retainer 22 is preferably made of a suitable spring steel material. Alternately as shown in FIGS. 9 and 10, a retainer 114 may be constructed with separate end portions 116,118 and a separate spring element, such as a die spring 120, for ease of manufacture of the retainer. As another alternative, a round wire spring 122, as shown in FIG. 11, could be used. The use of a non-metallic spring element, such as rubber or plastic, is also contemplated and may be employed in place of the steel springs shown herein.

Each of the end portions 98,100 or 116,118 of the retainer have a distal end 124 having a reduced diameter with a concave end face 126 formed therein.

While not shown in the drawings, the retainer disclosed herein may be employed with a bucket equipped with tooth adapters in place of mounting lugs 14. Such tooth adapters mount ground engaging teeth. In such a case, the retainer 22 would be used to detachably mount the teeth onto the adapters in the same fashion as described herein. On some larger buckets, a coupler may be employed between the tooth and adapter. In such a case, the retainer 22 may be used to detachably retain both the tooth onto the coupler and the coupler onto the adapter.

Also, the earthworking implement could be a ripper, rather than a bucket. In this application, the retainer 22 would be employed to retain a ripper tip onto the ripper shank of the ripper.

INDUSTRIAL APPLICABILITY

The earthworking implement 10 constructed in accordance with the present invention affords many advantages of prior devices. For instance, the present retainer 22 is easily assembled into and removed from the retainer pockets 32,54 of the tool mounting portion 16 and the ground engaging tool 18 through retainer opening 74 without the use of special tools and without the exertion of a large amount of effort. To install, the retainer 22 is compressed to its compressed length so as to pass through the retainer opening 74 into the pockets 32,54. This may be accomplished by angling one end of the retainer 22 in the retainer opening and tapping the other end with a hammer to compress the compressible middle portion 102 of the retainer. Once in the pockets 32,54, the retainer 22 will re-expand to its longer noncompressed length so as to prevent its escape out of the pockets through the retainer opening 74. Once in the pockets, the solid end portions 98,100 are adapted to abut the first and second abutment surfaces 32,56 of the mounting portion 14 and ground engaging tool 18, respectively, to prevent the tool from coming off the mounting portion in the primary direction of travel 24. Because all of the load bearing surfaces are cylindrical and concentric about the longitudinal axis 96 of the retainer 22 and the retainer 22 is free to rotate about such longitudinal axis, the resultant loads exerted on the end portions 98,100 are oriented normal to circular periphery of the end portions. Thus, the end portions are loaded in compression, rather than in shear. This loading characteristic enables the retainer 22 to carry greater loads. The reduced diameter distal ends 124 and the concave end faces 126 on the end portions 98,100 of the retainer 22 are provided to facilitate the removal of the retainer when desired. Such features provide niches for the end of a pry tool (not shown) to work against in order to re-compress the retainer to its compressed length so that the retainer 22 can be removed through the retainer opening 74.

Another advantage of the present invention resides in the particular construction of the mounting lug 14 and shroud 20. In such regard, the opposite sides 46,48 of lower leg 42 of the mounting lug 14 are provided with outwardly beveled flanges 50 adjacent the distal end 44. Such beveled flanges 50 are received within the mating inwardly beveled portions 92 of the second leg 68 of the shroud 20 for securing the second leg 68 to the mounting lug 14 and for transferring torsional loads on the shroud 20 to the mounting lug 14.

Other aspects and advantages of the present invention of this invention can be obtained through a study of the drawings, the disclosure and the appended claims.

What is claimed is:

1. In an earthworking implement adapted to normally engage the ground in a primary direction of travel, the improvement comprising:

a tool mounting portion having an exterior surface with a first retainer pocket therein, said first pocket providing a first abutment surface facing in a direction substantially away from said primary direction of travel;

a replaceable ground engaging tool having an interior surface positionable along said exterior surface of said mounting portion, said interior surface having a second retainer pocket therein positionable in alignment with said first retainer pocket of said mounting portion, said second pocket providing a second abutment surface disposed in a generally spaced, diametrically opposing relationship to said first abutment surface of said first retainer pocket; and an elongated retainer having a pair of opposite solid end portions, said retainer being positionable within said first and second retainer pockets wherein each of said end portions is oriented to abut both of said first and second abutment surfaces of both of said mounting portion and said tool, respectively, such that said end portions of said retainer restrict said tool from coming off said mounting portion in said direction of the primary direction of travel of said implement.

2. The earthworking implement of claim 1 wherein said elongated retainer has a longitudinal axis and an axially compressible middle portion between said opposite end portions whereby said retainer has a predetermined free length along said longitudinal axis of said retainer when in a noncompressed state and a shorter compressed length when said retainer in a compressed state.

3. The earthworking implement of claim 2 wherein said axially compressible middle portion of said retainer is a helical spring.

4. The earthworking implement of claim 3 wherein said helical spring is integral with said opposite end portions.

5. The earthworking implement of claim 4 wherein said retainer is constructed from spring steel.

6. The earthworking implement of claim 2 wherein said end portions of said elongated retainer each have a cylindrical surface portion thereon and wherein said first abutment surface of said tool mounting portion and said second abutment surface of said ground engaging tool each have cylindrical portions thereon, each such cylindrical portion being disposed about a central axis oriented generally transverse to said primary direction of travel and arranged such that the cylindrical portions of the first and second abutment surfaces contact the retainer in diametrically opposed relationship to each other, whereby said retainer is loaded in compression, rather that in shear.

7. The earthworking implement of claim 6 wherein said ground engaging tool has a cavity opening in a direction opposite to said primary direction of travel, said cavity being adapted to receive said tool mounting portion for mounting said tool onto said mounting portion.

8. The earthworking implement of claim 7 wherein said cavity has a leg with said interior surface and an opposite exterior surface, said exterior surface having a retainer opening therein through to said second retainer pocket, said retainer opening having a predetermined length that is less than the free length but greater than the compressed length of said retainer in order to permit the insertion of said retainer through said opening when in said compressed state but to prevent the escape of said retainer therethrough when in said noncompressed state.

9. The earthworking implement of claim 2 wherein said implement is a bucket.

10. The earthworking implement of claim 2 wherein said mounting member is an adapter and said tool is a bucket tooth.

11. The earthworking implement of claim 2 wherein said implement includes a coupler and said mounting portion is on said coupler.

12. The earthworking implement of claim 2 wherein said implement is a ripper and said mounting member is a ripper shank and said tool is a ripper tip.

13. The earthworking implement of claim 9 wherein said bucket has a cutting edge and wherein said tool mounting portion is provided on a mounting lug carried on said cutting edge and said ground engaging tool is a lip protecting shroud adapted to be mounted on said mounting lug.

14. The earthworking implement of claim 13 wherein said mounting lug includes a nose portion having a first planar force receiving end surface thereon oriented normal to said direction of travel and a pair of spaced force receiving surfaces, each normal to and adjoining said first force receiving surface and parallel to the direction of travel.

15. The earthworking implement of claim 14 wherein said lip protecting shroud has an elongated body tapering down from a wide mounting end portion to a narrower ground engaging end portion, said mounting end portion having a first leg and a second leg spaced from said first leg and defining a said open cavity therebetween, said cavity further having a first force transferring surface at the juncture of said legs and a pair of opposing force transferring surfaces, said first force transferring surface being positionable in force transferring abutment with said first force receiving surface and each of said opposing force transferring surfaces being positionable in force transferring abutment with a respective one of spaced force receiving surfaces on said nose portion of said mounting lug.

16. The earthworking implement of claim 15 wherein said mounting lug has an elongated lower leg having a distal end opposite said nose portion, said lower leg having opposite sides, each of such sides being provided with an outwardly beveled flange thereon adjacent said distal end, and wherein said shroud has an elongated lower leg having a distal end, said leg having a pair of inner flanges along a respective one of its opposite sides, each of said flanges having an inwardly beveled portion adapted to receive a respective one of the outwardly beveled flanges of the lower leg of the mounting lug.

17. A replaceable ground engaging tool for an earthworking implement adapted to normally engage the ground in a primary direction of travel, said tool being adapted to be detachably mounted to said implement by means of a retainer, said ground engaging tool comprising:

an elongated body tapering from a wide mounting end portion to a narrow ground engaging end portion, said mounting end portion having an open cavity facing generally away from said primary direction of travel, said cavity being defined by legs including a first leg, said first leg having an interior surface and an exterior surface, said interior surface having an elongated pocket formed therein, said pocket having a pair of sides at opposite ends thereof parallel to said primary direction of travel and an abutment facing in a direction of said primary direction of travel, and said exterior surface having an opening adapted to allow the passage of said retainer therethrough into said pocket.

18. The ground engaging tool of claim 17 wherein said tool is a shroud for protecting a bucket cutting edge, said shroud having a second leg spaced from said first leg and defining said open cavity therebetween, said cavity further having a first force transferring surface oriented normal to said direction of travel at the juncture of said legs and a pair of opposing force transferring surfaces, each normal to and adjoining said first force transferring surface and parallel to the direction of travel.

19. The ground engaging tool of claim 18 wherein said second leg of said shroud has a distal end and a pair of inner flanges along a respective one of its opposite sides, each of said flanges having an inwardly beveled portion thereon adjacent said distal end.

20. The ground engaging tool of claim 19 wherein said retainer is an elongated cylindrically shaped compression retainer and wherein elongated pocket includes a cylindrical portion disposed about a central axis oriented in a direction generally transverse to said primary direction of travel of said implement.

* * * * *